US005964571A

United States Patent [19]

Braner et al.

[11] Patent Number: 5,964,571

[45] Date of Patent: Oct. 12, 1999

[54] STACKING SYSTEM AND METHOD OF STACKING A PLURALITY OF ARTICLES

[76] Inventors: Harold R. Braner, 12128 Prosperity Farms Rd., Palm Beach Gardens, Fla. 33410; Tadeusz Marecki, 4016 N. Kostner St., Chicago, Ill. 60641

[21] Appl. No.: 09/002,974

[22] Filed: Jan. 5, 1998

[51] Int. Cl.[6] ..... B65H 29/00

[52] U.S. Cl. ..... 414/792.7; 414/793.8; 414/794.8

[58] Field of Search ..... 414/792.7, 793.4, 414/793.8, 794.8

[56] References Cited

U.S. PATENT DOCUMENTS

| | | | |
|---|---|---|---|
| 3,729,190 | 4/1973 | Harris et al. | 414/792.7 |
| 3,861,536 | 1/1975 | Braner et al. | 414/793.4 |
| 3,891,204 | 6/1975 | Mager | 414/792.7 |
| 3,910,425 | 10/1975 | Mahara et al. | 414/794.8 |
| 4,055,261 | 10/1977 | Schneider | 414/793.8 |
| 4,927,321 | 5/1990 | Lucas | 414/794.8 |

OTHER PUBLICATIONS

Braner Engineering, Inc. Brouchure, "Coil Slitting, Processing and Packaging Systems", date unknown.

Braner Engineering, Inc. Brochure Containing information on general arrangement banding system, date unknown.

Photocopy of a photograph of Typical Braner Coil Slitting Processing and Packaging Line.

*Primary Examiner*—Christopher P. Ellis
*Assistant Examiner*—Gregory A. Morse

[57] ABSTRACT

A stacking system for vertically stacking a plurality of articles comprising: a transport table, a stacking area, an arm member, a vertical moving member, and a coordinating device. The transport table includes a first end and a second end, and a member for slidably moving an article of the plurality of articles from the first end to and beyond the second end of the transport table. The stacking area preferably is a table which includes a top surface and a proximal end region associated with the second end of the transport table. The arm member includes an engaging member slidably movable over at least a portion of the stacking table. The engaging member is capable of releasably engaging a portion of the article as the article extends beyond the second end of the transport table. The vertical movement member moves one of the stacking table or the transport table and the arm member into the desired orientation relative to the stacking table. The coordinating device coordinates the vertical movement member and the slidable movement of the engaging member. This, in turn, facilitates stackable positioning of the plurality of articles upon the top surface of the stacking table. The invention likewise includes a method of stacking a plurality of articles.

13 Claims, 3 Drawing Sheets

STACKING SYSTEM AND METHOD OF STACKING A PLURALITY OF ARTICLES

BACKGROUND OF THE INVENTION

1. Field of the invention

The invention is directed to stacking systems, and more particularly a system for stacking a variety of large and heavy objects, such as steel coils upon each other.

2. Background Art

The stacking of articles has long been known in the art. Often, for transportation, a first article is positioned on a pallet. Subsequently, additional articles are stacked on top of the first article. Once the articles have been stacked, the stack of articles is fastened together, through bands, chains, tape and the like.

Such a practice has long been done with heavy steel coils. These coils often weigh hundreds, and even thousands of pounds each. As such, they are difficult to move and maneuver. In the past, certain methods have been developed to facilitate the stacking of these rolled sheets. One method has been the use of two grabbing cranes rotatably mounted about a common center, and about 180° apart. The supply conveyor is positioned at one end and the destination stack is positioned 180° from the supply, and abut the common center of the cranes. In operation, the first crane picks the first coil. Subsequently, the cranes rotate one half turn, thereby positioning the first crane and the coil proximate the destination stack, and the second crane proximate the supply conveyor. Accordingly, as the first crane releases the coil on the destination stack, the second crane picks up a second coil. The cranes again rotate one half turn, and the procedure is repeated until the stack is completed. Such a procedure is time consuming and extremely labor intensive. Additionally, such a procedure requires a substantial amount of space inasmuch as the the cranes require substantial room to maneuver. Moreover, the physics of starting and stopping the cranes over the appropriate areas are complicated due to the large moments of inertia caused by rotating large and heavy articles such as steel coils.

SUMMARY OF THE INVENTION

The invention comprises a stacking system for continuous stacking of a plurality of articles. The stacking system comprises a transport table, a stacking area, an arm member, means for vertically moving and means for coordinating. The transport table includes a first end and a second end and means for slidably moving an article of the plurality of articles from the first end to the second end. The stacking area is associated with the second end of the transport table. The arm member includes an engaging member. The engaging member slidably movable over at least a portion of the stacking area. The engaging member is capable of releasably engaging at least a portion of the article as the article extends beyond the second end of the transport table. The vertical moving means moves at least one of the stacking area or the transport table and arm member. The coordinating means coordinates the vertical movement means and the slidable movement of the arm member to facilitate stackable positioning of the articles upon the stacking area.

In a preferred embodiment, the slidable movement means comprises a plurality of roller elements associated with an upper surface of the transport table.

In another preferred embodiment, the arm member further includes a releasing member facilitating the disengagement of the arm member from the articles upon properly positioning of the article relative to the stacking area. In such a preferred embodiment, the releasing member comprises a pivotable portion of the arm member.

Preferably, the engagement member comprises a lower inward protrusion capable of engaging in a lower portion of the article.

In a preferred embodiment, the stacking system further includes means for delivering the articles onto the transport table at predetermined intervals. In such an embodiment, the coordinating means further coordinates the vertical movement means and the arm member to facilitate continuous stacking of the plurality of the articles. In such a preferred embodiment, the delivery means comprises an introduction table associated with the first end of the transport table. The introduction table includes second means for slidably moving an article. Preferably, in this embodiment the vertical movement means is capable of vertically moving the transport table and arm member together, in combination, from a first level corresponding to the height of the introduction table to a second level corresponding to the height of the stacking area.

In another preferred embodiment, the stacking area comprises a stacking table having a top surface and a proximal end region.

The invention further includes a method for stacking an article upon a stacking area. The method comprises the steps of (a) a transport table having a first end and a second end, said transport table having means for slidably moving an article of the plurality of articles from said first end thereof to, and beyond, said second end thereof; (b) a stacking area associated with said second end of said transport table; (c) an arm member having an engaging member slidably movable over at least a portion of said stacking area, said engaging member capable of releasably engaging at least a portion of the article as said article extends beyond said second end of said transport table; (d) means for vertically moving at least one of said stacking table or said transport table and arm member; and (e) means for coordinating said vertical movement means and said slidable movement of said arm member, to, in turn, facilitate stackable positioning of the articles upon said stacking area.

In a preferred embodiment, the method may further include the step of stacking a subsequent article upon the first article. In such a preferred embodiment, the step of subsequent article stacking comprises the steps of (a) repeating the steps of positioning, moving, engaging, directing and reorienting with a subsequent article; and (b) disengaging the arm member from the subsequent, to, in turn, position the subsequent article on at least a portion of the first article.

DETAILED DESCRIPTION OF THE DRAWINGS

Figure 1:
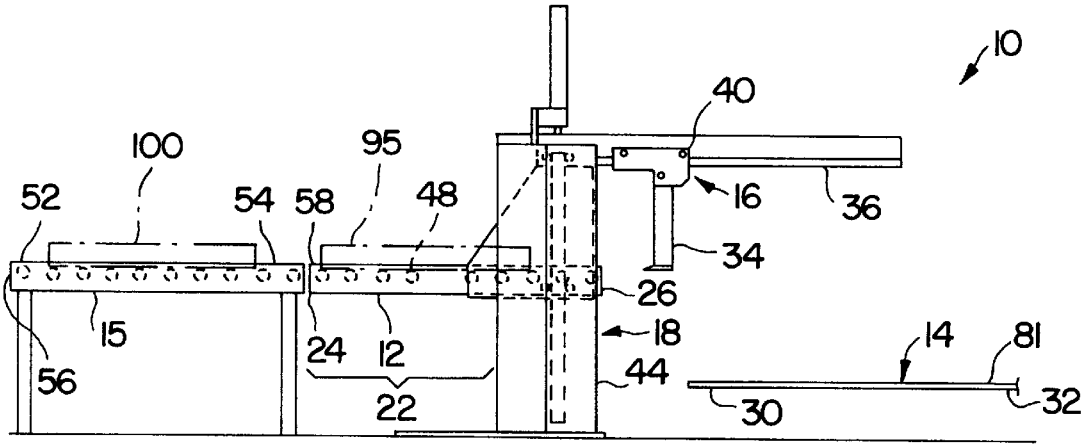
FIG. 1 of the drawings is a side elevational view of the invention, showing in particular an article as it extends along the transport table.
Figure 2:
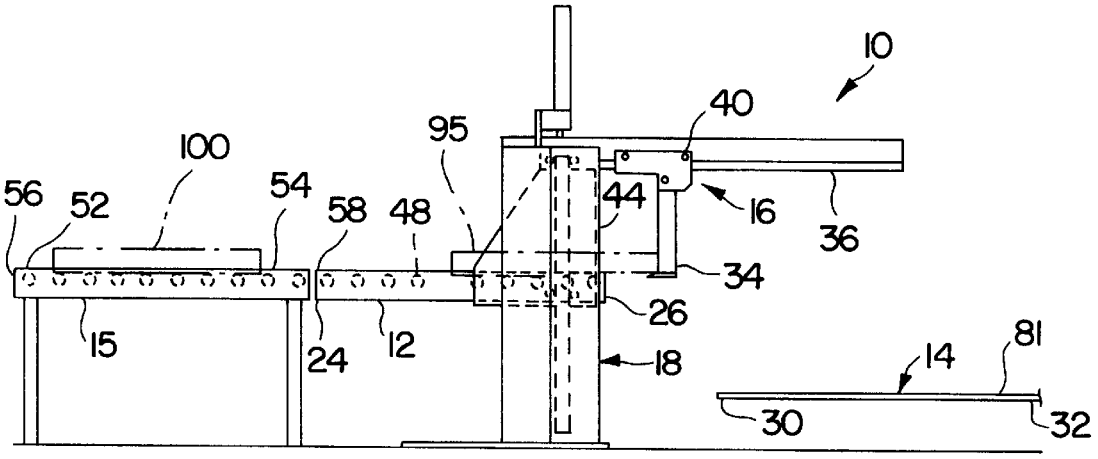
FIG. 2 of the drawings is a side elevational view of the invention, showing in particular the article as the article engages the engaging member.
Figure 3:
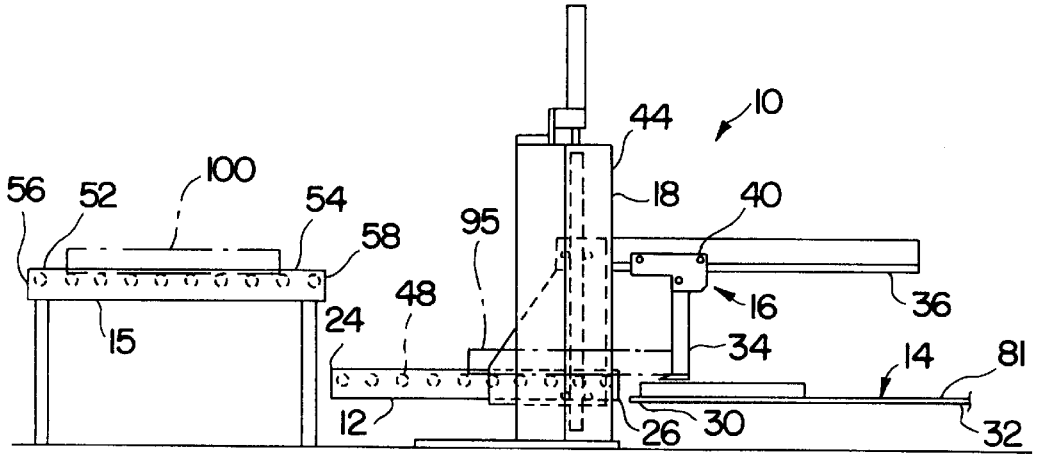
FIG. 3 of the drawings is a side elevational view of the invention, showing in particular the article as the transport table and the arm are moved in a downward direction.
Figure 4:
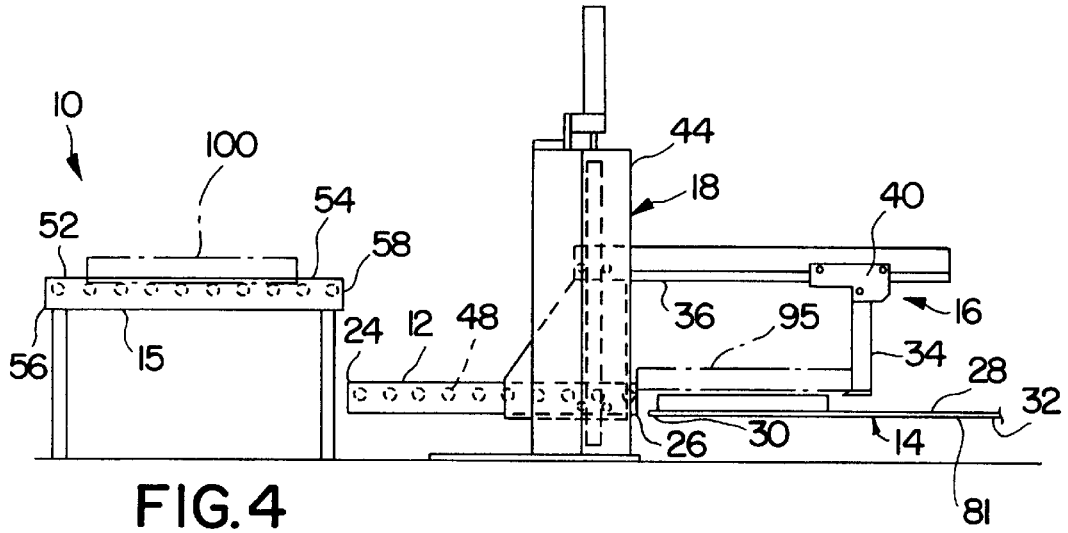
FIG. 4 of the drawings is a side elevational view of the invention, showing in particular the article as the article is transferred to the stacking area.
Figure 5:
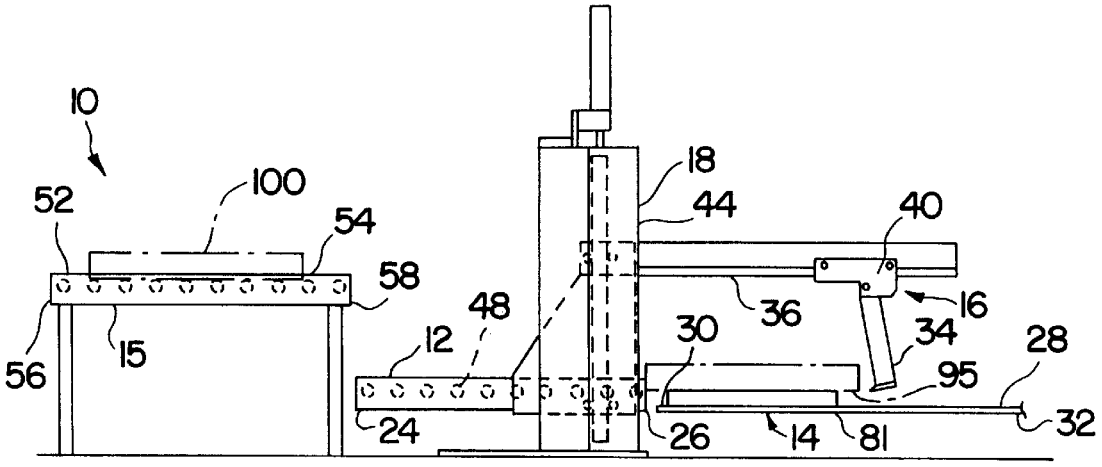
FIG. 5 of the drawings is a side elevational view of the invention, showing in particular the article as the engaging member disengages from the article.
Figure 6:
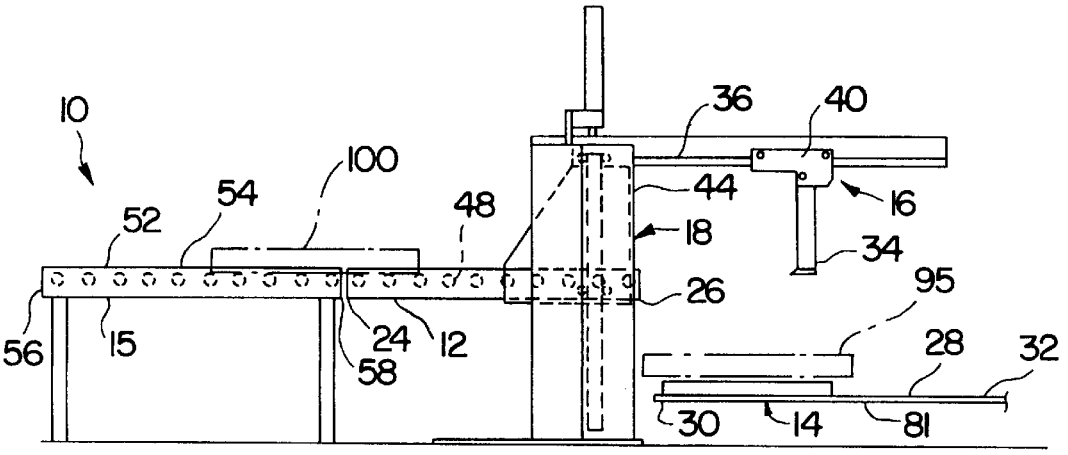
FIG. 6 of the drawings is a side elevational view of the invention, showing in particular the return of the transport table and the arm to their original positions.

While this invention is susceptible of embodiment in many different forms, there is shown in the drawings and will herein be described in detail, one specific embodiment with the understanding that the present disclosure can be considered as an exemplification of the principles of the invention and is not intended to limit the invention to the embodiment illustrated.

Stacking system 10 for stacking a plurality of articles, such as article 95, is shown in FIGS. 1–8 as comprising transport table 12, stacking area 14, arm member 16, means 18 for vertically moving the transport table and the arm member, means 15 for delivering articles 95, and means for coordinating delivery means 15, arm member 16 and vertical movement means 18. Articles 95 may comprise a variety of structures that can be stacked. For instance, articles 95 may comprise long rolls of sheet metal, roll stock or steel coils.

Delivery means 15 is shown in FIGS. 1–8 as comprising introduction table 52. Introduction table 52 includes first end 56, second end 58 and drive rollers 54. Drive rollers 54 extends between first end 56 and second end 58 and is positioned on an upper surface thereof. As will be explained, delivery means 15, through drive rollers 54, transports articles 95 from first end 56 to second end 58, and, in turn, onto transport table 12.

Of course, in place of powered drive rollers 54, introduction table 52 may comprise a series of low friction roller members positioned on the upper surface of the introduction table. As such, once an article is positioned on introduction table 52, a slight impact on article 95 will cause article 95 to slide along the roller members from first end 56 to second end 58 of introduction table 52. Additionally, introduction table 52 may include a section that is inclined in a downward direction from first end 56 to second end 58 of introduction table 52, so that gravity will direct article 95 to second end 58 of introduction table 52.

Transport table 12 is shown in FIGS. 1–8 as comprising first end 24, second end 26 and means 22 for facilitating slidable movement of the article from first end 24 to second end 26. First end 24 of transport table 12 is associated with second end 58 of introduction table 52. The distance between first end 24 and second end 26 may vary with the particular application and the particular size of the articles to be stacked.

Slidable movement facilitating means 22 is shown in FIGS. 1–8 as comprising powered drive rollers 48 which extends from first end 24 to second end 26 of transport table 12. As such, article 95 positioned on first end 24 of drive rollers 48 can be moved toward and beyond second end 26 of transport table 12 by drive rollers 48. Of course, just as with respect to introduction table 52, slidable movement facilitating means 22 may include a series of free-wheeled roller members. Additionally, transport table 12 may include a portion that is inclined in a downward direction, from first end 24 to second end 26.

Stacking area 14 is shown in FIGS. 3–6 as comprising stacking table 81 having top surface 28, proximal region 30 and distal region 32. Top surface 28 is substantially planar and capable of accepting and retaining a plurality of articles 95 positioned thereon. Proximal region 30 is associated with second end 26 of transport table 12. While proximal region 30 is shown to abut second end 26 of transport table 12, such abutment is not necessary. Stacking area 14 may alternatively comprise any number of structures, such as a transportable pallet, a flat bed truck, a fork lift, among other structures. Additionally, stacking tables may comprise a turret that is rotatable about a center or other structures that facilitate continuous stacking articles. Further, stacking area 14 may merely comprise a designated region on the floor or ground surface.

Figure 7:
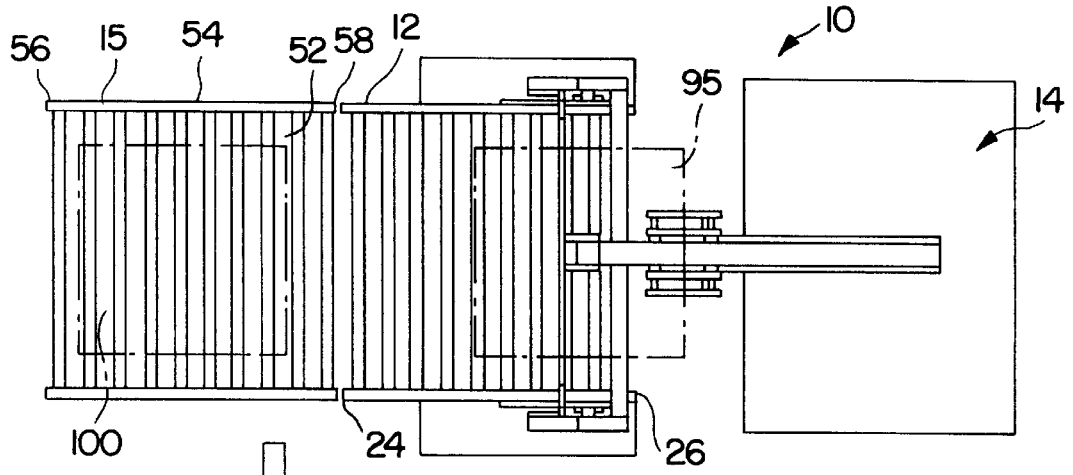
FIG. 7 of the drawings is a top plan view of the invention.
Figure 8:
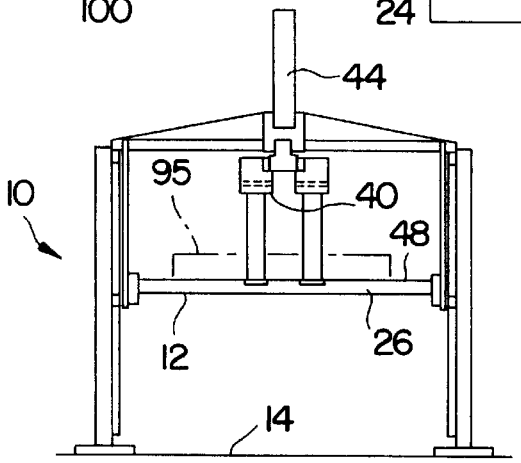
FIG. 8 of the drawings is a front elevational view of the invention.

Arm member 16 is shown in FIGS. 1–10 as comprising engaging member 34, channel 36, and disengaging member 39. Engaging member 34 includes a lower protrusion member which is capable of engaging a portion of a lower region of article 95. Channel 36, as shown in FIG. 7, extends over at least a portion of stacking table 81. As will be explained, channel 36 facilitates the slidable movement of engaging member 34 along channel 36, and, in turn, over at least a portion of stacking table 81.

Figure 9:
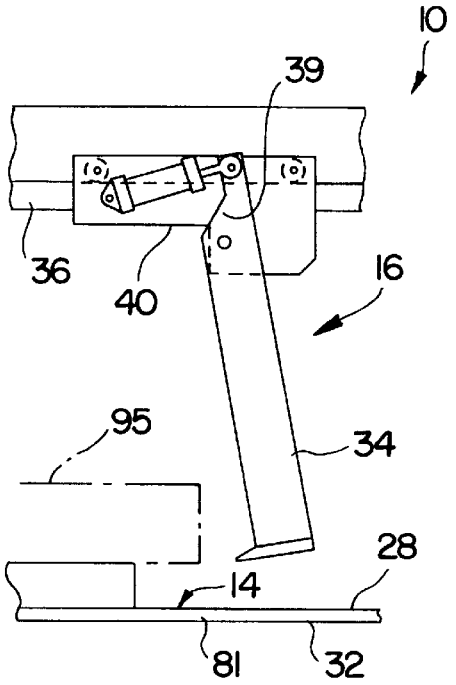
FIG. 9 of the drawings is a partial side elevational view the arm member, showing in particular the disengagement from the article.
Figure 10:
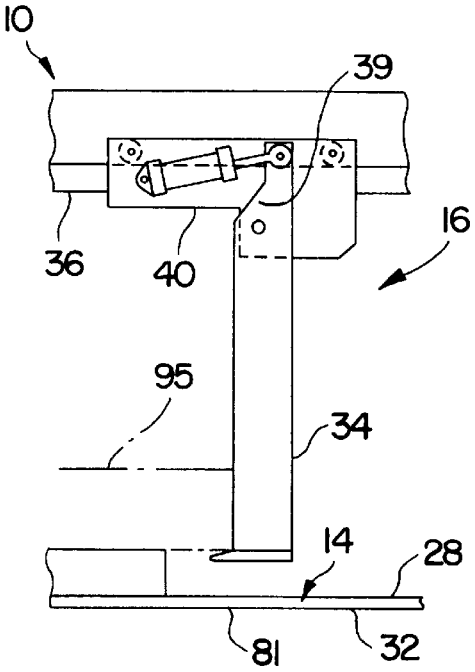
FIG. 10 of the drawings is a partial side elevational view of the arm member, showing in particular the engagement with the article.

Disengaging member 39, as shown in FIGS. 9–10, comprises pivoting region 40 which facilitates the pivoting of engaging member 34. Specifically, and as will be explained, pivoting region 40 permits the pivoting of engaging member 34 relative to channel 36. This pivoting movement essentially disengages engaging member 34 from article 95, permitting article 95 to be transferred to stacking table 81.

Vertical movement means 18 is shown in FIGS. 1–6 as comprising lift 44. Lift 44 facilitates the vertical movement of transport table 12 from a first level substantially corresponding to the level of introduction table 52 to a second level substantially corresponding to the level of stacking table 14. Further, and simultaneously, lift 44 facilitates the vertical movement of channel 36, and, in turn, engaging member 34. Of course, it is likewise contemplated that vertical movement means may vertically alter the position of stacking table 81 and introduction table 52 instead of transport table 12 and arm member 16, or both simultaneously.

As will be explained with respect to the operation, through coordinating means, the coordination of the articles and the stacking thereof can occur on continuously. Specifically, by coordinating any or all of (1) the placement of the articles on the introduction table, (2) the advancement of articles from the introduction table to transfer table, (3) the vertical movement of the transfer table and arm member, (5) the release of the engagement member and (5) the return of the transfer table and the arm member, the stacking of articles can occur at a predetermined continuous rate.

In operation, article 95 is first positioned onto introduction table 52 proximate first end 56 thereof. Article 95 may be positioned upon introduction table 52 through various equipment such as a feeder station, a fork lift, a crane, among other equipment.

Once article 95 travels from first end 52 to second end 58 of introduction table 52 through powered rollers 54, article 95 moves onto transport table 12 proximate first end 24 thereof. Of course, it is likewise contemplated that for certain applications, introduction table 52 may be eliminated and the placement of article 95 will be directly onto transport table 12 through the above-identified equipment.

Once article 95 is positioned on transport table 12, slidable movement means 22 slidably moves article 95 from first end 24 thereof to second end 26 thereof. As article 95 reaches second end 26 of transport table 12, engaging member 34 engages a portion of the lower region of article 95. Once engaged, article 95 travels beyond second end 26 of transport table 12 engaged to engaging member 34.

As article 95 traverses the transport table, transport table 12, along with arm member 16, through vertical movement means 18, moves from the level of introduction table 52 to the proper level just above stacking table 81. Through coordinating means, the vertical movement is coordinated so that just as vertical movement means 18 positions the transport table, arm member 16, and, in turn, article 95 into proper position relative to stacking table 81, article 95 fully extends beyond second end 26 of transport table 12.

At such time, engaging member 34 disengages and article 95 is transferred to the top surface of stacking table 81. Once article 95 is transferred, transport table 12 and arm member 16 begin to return to the original level corresponding to introduction table 52. Further, engaging member 34 returns along slot 36 to its original position proximate second end 26 of transport table 12.

Just as transport table 12 returns to its original position, a subsequent article 100 of the plurality of articles approaches second end 58 of introduction table 52. Just as with first article 95, subsequent article 100 eventually passes to first end 24 of transport table 12 and, through slidable movement means, slidably moves to second end 26 thereof. Once a portion of subsequent article 100 reaches second end 26, engaging member 34 engages a portion of subsequent article 100 and retains article 100 as it continues to move beyond second end 26 of transport table 12.

As with the stacking of first article 95, as subsequent article 100 progresses along and beyond transport table 12, transport table 12 and arm 16, through vertical movement means 18, move vertically toward the appropriate level. Through coordinating means, as transport table 12 and arm member 16 are properly positioned relative to stacking table 81 and first article 95, subsequent article 100 extends beyond transport table 12 and arm 16 disengages, thus transferring subsequent article 100 on top of first article 95, in a stacked orientation.

The foregoing steps can be repeated with further subsequent articles until a desired stack of articles has been obtained. The stacked articles are then fully prepared for further transport or use. They may be moved, and, a new stack can be started.

In alternative embodiments, the transport table and the arm member may remain stationary, and vertical movement means may move the stacking table in an upward vertical direction until the stacking table is in a proper orientation relative to the transport table 12. Further still, in other embodiments, the vertical movement means can vertically move the transport table and arm member combination, as well as, the stacking table to properly orient the tables relative to each other.

The foregoing description and drawings merely explain and illustrate the invention and the invention is not limited thereto, except insofar as the appended claims are so limited as those skilled in the art who have the disclosure before them will be able to make modifications and variations therein without departing from the scope of the invention.

We claim:

1. A stacking system for vertically stacking a plurality of articles, the stacking system comprising:

a transport table having a first end and a second end, said transport table having means for slidably moving an article of the plurality of articles from said first end thereof to, and beyond, said second end thereof;

a stacking area associated with said second end of said transport table;

an arm member having an engaging member slidably movable over at least a portion of said stacking area, said engaging member capable of releasably engaging at least a portion of the article as the article extends beyond said second end of said transport table;

means for vertically moving at least one of said stacking area or said transport table and arm member; and means for actively coordinating said vertical movement means and said slidable movement of said arm member, while said article is in transition from said transport table to said stacking area, to, in turn, facilitate stackable positioning of articles upon said stacking area.

2. The stacking system according to claim 1 wherein said slidable movement means comprises a plurality of roller elements associated with an upper surface of the transport table.

3. The stacking system according to claim 1 wherein said arm member further includes a releasing member facilitating the disengagement of said arm member and one of the plurality of articles, upon proper positioning of the article relative to said stacking area.

4. The stacking system according to claim 3 wherein said releasing member comprises a pivotable portion of said arm member.

5. The stacking system according to claim 1 wherein said engaging member comprises a lower inward protrusion capable of engaging a lower portion of the article.

6. The stacking system according to claim 1 further including means for delivery of articles to the transport table at predetermined intervals.

7. The stacking system according to claim 6 wherein said coordinating means further coordinates said vertical moving means and said arm member to facilitate continuous stacking of the plurality of articles.

8. The stacking system according to claim 6 wherein said delivery means comprises an introduction table associated with said first end of said transport table, said introduction table including second means for slidably moving an article thereon.

9. The stacking system according to claim 1 wherein said stacking area comprises a stacking table having a top surface and a proximal end region.

10. A stacking system for vertically stacking a plurality of articles, the stacking system comprising:

a transport table having a first end and a second end, said transport table having means for slidably moving an article of the plurality of articles from said first end thereof to, and beyond, said second end thereof;

a transport table having a first end and a second end, said transport table having means for slidably moving an article of the plurality of articles from said first end thereof to, and beyond, said second end thereof;

a stacking area associated with said second end of said transport table;

an arm member having an engaging member slidably movable over at least a portion of said stacking area, said engaging member capable of releasably engaging at least a portion of the article as the article extends beyond said second end of said transport table;

means for vertically moving said transport table and arm member; said vertical moving means being capable of vertically moving said transport table and said arm member together, in combination, from at least a first level corresponding to the height of said introduction table to a second level corresponding to the height of said stacking area;

means for coordinating said vertical movement means and said slidable movement of said arm member, to, in turn, facilitate stackable positioning of the articles upon said stacking areas; and means for delivery of articles to the transport table at predetermined intervals; said delivery means comprises an introduction table associated with said first end of said transport table, said introduction table including second means for slidably moving an article thereon.

11. A method for stacking an article upon a stacking area comprising:

positioning a first article on a transport table having a first and a second end;

moving the first article along said transport from said first end to said second end and, beyond said second end thereof;

engaging at least a portion the first article with an arm member as the first article extends beyond said second end;

directing the first article through movement of said arm member in a substantially horizontal direction;

reorienting one of a stacking area or said transport table and said arm member in coordinated combination as said article transitions from said transport table to said stacking area to facilitate proper positioning said stacking area as the article extends beyond said second end of said transport table; and disengaging said arm member from the article, to, in turn, position the article on said stacking area.

12. The method of stacking according to claim 11 further comprising the step of:

stacking a subsequent article upon the first article.

13. The method of stacking according to claim 12 wherein the step of subsequent article stacking comprises the steps of:

repeating the steps of positioning, moving, engaging, directing and reorienting with a subsequent article; and disengaging the arm member from the subsequent, to, in turn, position the subsequent article on at least a portion of the first article.

* * * * *